United States Patent [19]

Defosse et al.

[11] Patent Number: 4,523,573

[45] Date of Patent: Jun. 18, 1985

[54] APPARATUS FOR PROPELLING AN INFLATED BALL

[75] Inventors: Georges Defosse, Barchon; Joseph Hensenne, Haccourt, both of Belgium

[73] Assignee: Ateliers de Constructions Electriques de Charleroi, Charleroi, Belgium

[21] Appl. No.: 281,863

[22] Filed: Jul. 9, 1981

Related U.S. Application Data

[63] Continuation-in-part of Ser. No. 147,597, May 7, 1980, abandoned.

[30] Foreign Application Priority Data

May 7, 1979 [EP] European Pat. Off. ..... 79200221.4

[51] Int. Cl.[3] ..... F41B 3/00

[52] U.S. Cl. ..... 124/41 R; 124/81

[58] Field of Search ..... 124/41 R, 41 C, 36, 124/32, 81, 1, 80; 273/291 R, 291 S

[56] References Cited

U.S. PATENT DOCUMENTS

| | | | |
|---|---|---|---|
| 3,105,683 | 10/1963 | Kimbrell | 124/4 X |
| 3,261,340 | 7/1966 | Laird . | |
| 3,310,312 | 3/1967 | Peeples . | |
| 3,635,204 | 1/1972 | Plumb, Jr. . | |
| 3,878,827 | 4/1975 | Newgarden | 124/81 |
| 4,026,261 | 5/1977 | Paulson et al. . | |
| 4,335,701 | 6/1982 | Bozich | 124/81 X |

FOREIGN PATENT DOCUMENTS

| | | |
|---|---|---|
| 7433624 | 10/1974 | Fed. Rep. of Germany . |
| 2651335 | 6/1977 | Fed. Rep. of Germany . |
| 1039105 | 8/1966 | United Kingdom . |

*Primary Examiner*—Richard J. Apley
*Assistant Examiner*—William R. Browne
*Attorney, Agent, or Firm*—Schwartz, Jeffery, Schwaab, Mack, Blumenthal & Koch

[57] ABSTRACT

The apparatus has a striking mass which strikes a ball and a support for the ball to be struck. The ball is held to the support by a frame or by a suction apparatus. The ball may be given a curved trajectory by either rotating the ball support and ball or by rotating the striking mass at the time of impact.

14 Claims, 9 Drawing Figures

APPARATUS FOR PROPELLING AN INFLATED BALL

This is a continuation-in-part of application Ser. No. 147,597, filed May 7, 1980, now abandoned.

BACKGROUND OF THE INVENTION

There are a number of patents for devices for propelling an inflatable ball using springs or elastics, compressed air, rollers or pulleys turning at high speed, or oscillating arms driven by a spring or an elastic or a rotating motor.

These devices propel the ball in a curved or elongated trajectory according to the elevation setting of a guideway which is adjustable with respect to the horizontal setting of the device.

However, these devices cannot impart a hooked trajectory to the ball, in planned fashion, as a player can do by altering the point of impact on the ball such that the ball rotates around an axis which depends on the position of the point of impact with respect to the center of gravity of the ball.

SUMMARY OF THE INVENTION

The present invention has for its object a device for propelling an inflated ball which enables one to give the ball a hooked trajectory. It is characterized in that rotation at a predetermined rate around a predetermined axis is imparted to the ball in the launch position.

BRIEF DESCRIPTION OF THE DRAWINGS

The invention is set forth in more detail by referring to the attached drawings, which represent just one example embodiment.

DETAILED DESCRIPTION OF THE EMBODIMENT

Figure 1:
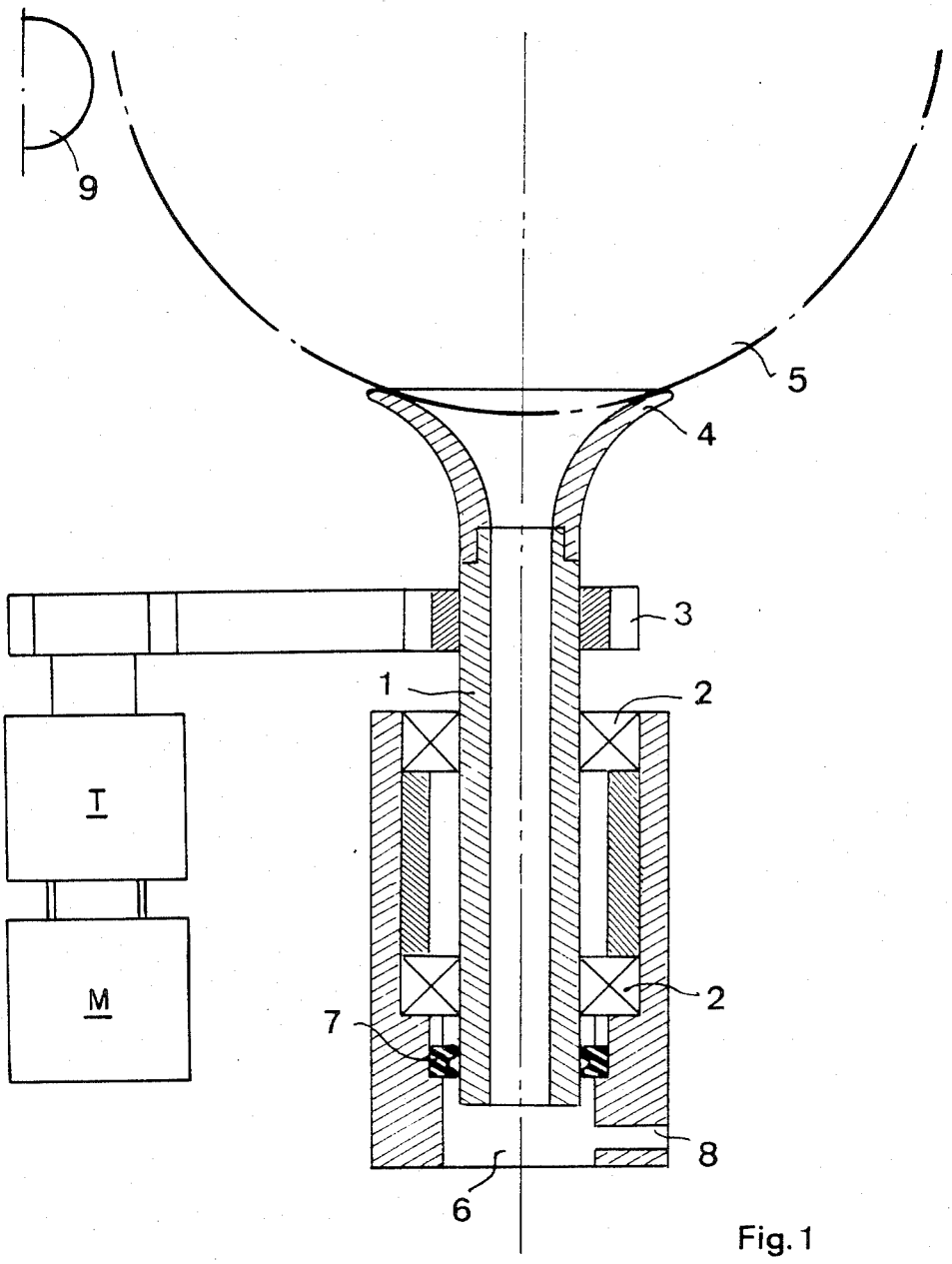
FIG. 1 is a cross-sectional view of part of the assembly a first embodiment of a ball support.

In FIG. 1, hollow shaft 1 is supported by two bearings 2 and is rotated via a pinion 3 connected to a motor by a transmission means (not shown).

Hollow shaft 1 supports, on its top end, a ball-support device 4 for inflated ball 5. The device is a concave platform with a diameter much less than that of ball 5, and is designed to accurately position the ball.

The lower end of hollow shaft 1 opens out into chamber 6 which is sealed airtight by joint 7.

Tube 8 opening out into said chamber 6 is in fluid communication with an aspiration system (not shown).

When ball 5 rests on platform 4, the closing off of the concave platform 4 enables the associated aspiration system to produce a certain vacuum via the link comprising tube 8, airtight chamber 6, and hollow shaft 1, thus assuring that the ball will be held firmly. As soon as this has been accomplished, hollow shaft 1 can be set into rotation via pinion 3, thus causing the ball to rotate at a predetermined speed. The ball does not slide on its suppport even if the ball has a major imbalance, if it has imperfections in sphericity, if dirt is collected on its surface, or if the diameter of the ball varies as a function of its degree of inflation or for any other reason (e.g., the fact that balls of different physical characteristics are supplied to the device). The transmission means T for the motor M enables pinion 3 to be driven at a speed which may be controlled as desired. The motor may be reversible, variable speed electric motor, or the motor may be a turbine driven by a flowing fluid.

Striking mass 9, which is moved in a manner which is itself known, transmits to ball 5 movement needed to send the latter in a direction defined by a guideway, which guideway is also itself known. Care must be taken at the time of impact to ensure that striking mass 9 does not significantly retard the rotation of the ball which is responsible for the latter's hooked trajectory.

Figure 2:
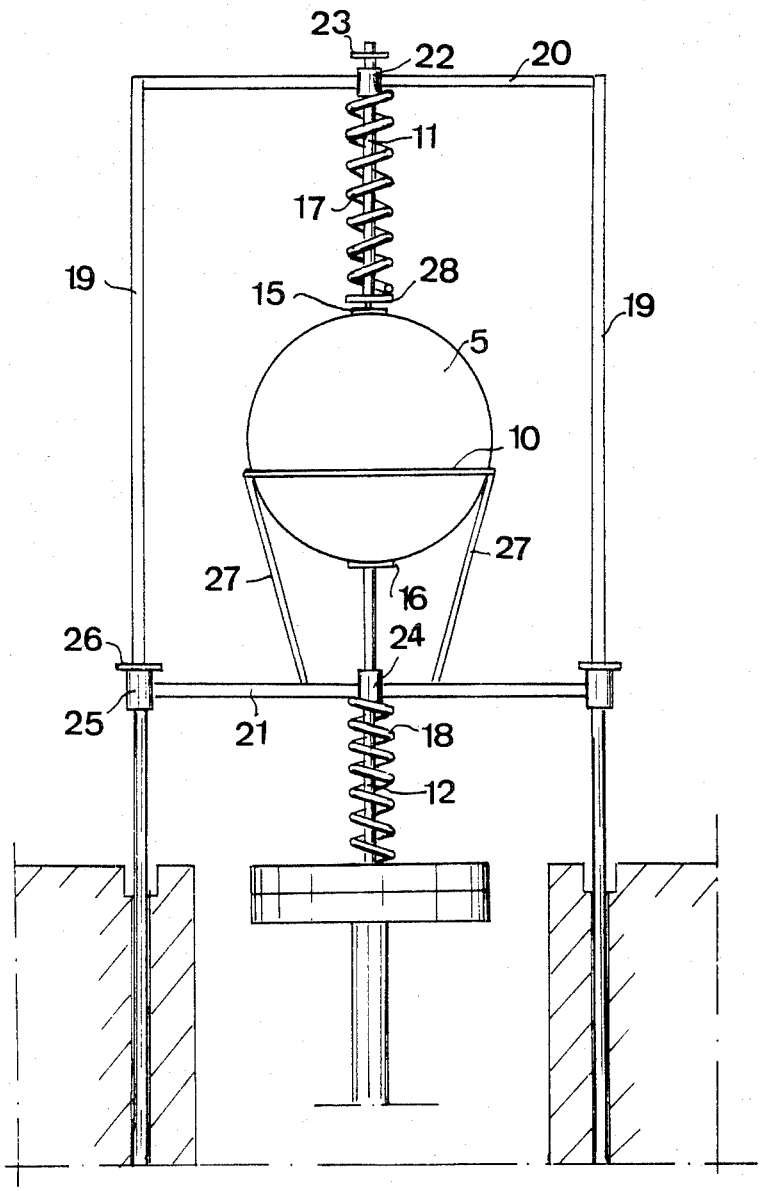
FIG. 2 shows a second embodiment of a ball support.

FIG. 2 shows a variation of a device allowing a rotational movement to be imparted to ball 5 before the propelling blow. This device comprises a ring 10 for centering the diameter, disposed below ball 5 and coaxially with two shafts 11 and 12 which are disposed respectively above and below ball 5 along a common vertical axis, and which each terminate in an end piece (15 and 16) of diameter substantially less than that of the ball. Two helical springs 17 and 18 run along shafts 11 and 12, respectively, being slid over them. Shafts 11 and 12 and ring 10 are connected by the intermediary of a frame formed from at least one vertical post 19, at least one upper horizontal arm 20 which is solidly attached to vertical post 19, and at least one lower horizontal arm 21 which slides along vertical post 19.

Upper horizontal arm 20 which is solidly attached to vertical post 19 supports a sleeve 22 in which upper shaft 11 slides. The excursion of shaft 11 is limited by a detent 23. Lower horizontal arm 21 supports, on one of its ends, a sleeve 24 in which lower shaft 12 slides.

The other end of lower horizontal arm 21 supports at least one sleeve 25 which permits displacement of arm 21 with respect to vertical post 19. The excursion of arm 21 on post 19 is limited by detent 26.

Lower horizontal arm 21 also supports ring 10 by the intermediary of oblique struts 27.

Lower shaft 12, which is solidly attached to end piece 16, is rotationally driven via a transmission means (not shown).

End piece 15 pivots freely on upper shaft 11 which is terminated in detent 28 which receives the pressing force of helical spring 17.

In order to facilitate the positioning, manual or automatic, of ball 5, the frame formed by post or posts 19 and arm 20 is put into a raised position. In this position, ring 10 is pressed on by helical spring 18, via lower horizontal arm 21 and oblique struts 27, so as to occupy an elevated position, thus permitting the centering of ball 5 without the latter touching end piece 16 on lower shaft 12. The frame formed by post(s) 19 and arm 20 is then lowered until end piece 15 on upper shaft 11 comes into contact with ball 5. During this entire operation, vertical post 19 slides in sleeve 25 which is fixed at the end of lower horizontal arm 21, thus permitting ring 10 to remain in its initial elevated position.

As the frame formed from post(s) 19 and arm 20 continues its descent it compresses spring 17 via sleeve 22, and thus the increasingly tighter holding in place of ball 5 is ensured. At the same time the pressing force of detent 26 on sleeve 25 progressively retracts ring 10 and thereby opens up access to ball 5. The lowering movement is stopped when ring 10 reaches the level of end piece 16 on shaft 12.

The rotation of the ball via lower shaft 12 which is solidly attached to its end piece 16 is effected by a motor means (not shown) which imparts the desired rotational speed to ball 5. The pressing force of helical spring 17 ensures that ball 5 is kept along a fixed axis defined by shafts 11 and 12; and the pivoted end piece 15 permits the ball to be rotated without carrying along shaft 11 and helical 17 spring in the rotational movement.

When the ball has attained the desired rotational speed the propelling blow is delivered in a direction perpendicular to the plane of the frame formed by elements 19, 20 and 21.

Of course, it is possible to incline the axis of rotation to a predetermined angle, for example by tilting frame 19, 20 and 21 in FIG. 2 or chamber 6 in FIG. 1, to achieve the desired effects on the trajectory of the ball.

Figure 3:
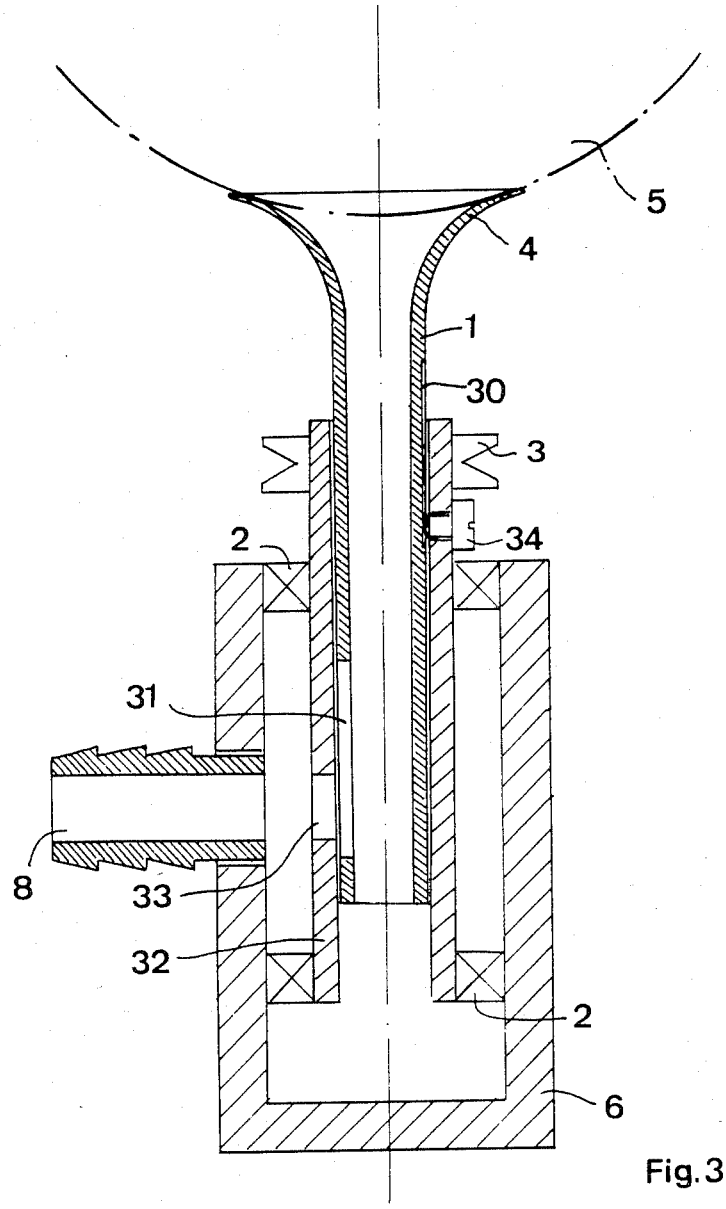
FIG. 3 shows a third embodiment of a ball support.

FIG. 3 shows another variant of a support device which permits a rotational motion to be imparted to a ball 5 prior to a propelling blow. Hollow shaft 1, which is terminated at its top end by concave platform 4, is provided with a groove 30 and also an oblong opening 31 on its lower part. A tube 32, coaxial with hollow shaft 1 and mounted on two ball bearings 2, is provided with an opening 33 opposite opening 31 of hollow shaft 1, and is further provided with a set screw 34 which fixes tube 32 to hollow shaft 1.

The bore of tube 32 allows greased axial sliding of hollow tube 1 in it, for the purpose of controlling the elevation with respect to the striking mass.

Tube 32 is rotated via pinion 3 which is connected to a motor by a drive means (not shown).

The rotational movement of tube 32 is transmitted to hollow shaft 1 via screw 34, the end of which engages groove 30 in hollow shaft 1. Groove 30 in hollow shaft 1 is of such a length as to permit displacement of hollow shaft 1 with respect to tube 32, over a height sufficient for concave platform 4 to hold ball 5 at the different elevations required, whereby striking mass 9 may impart the desired trajectory effects to the ball.

Ball 5 is held on concave platform 4 by aspiration across tube 8 and the link comprising hollow shaft 1 and openings 31 and 33 in hollow shaft 1 and tube 32, respectively.

Figure 4:
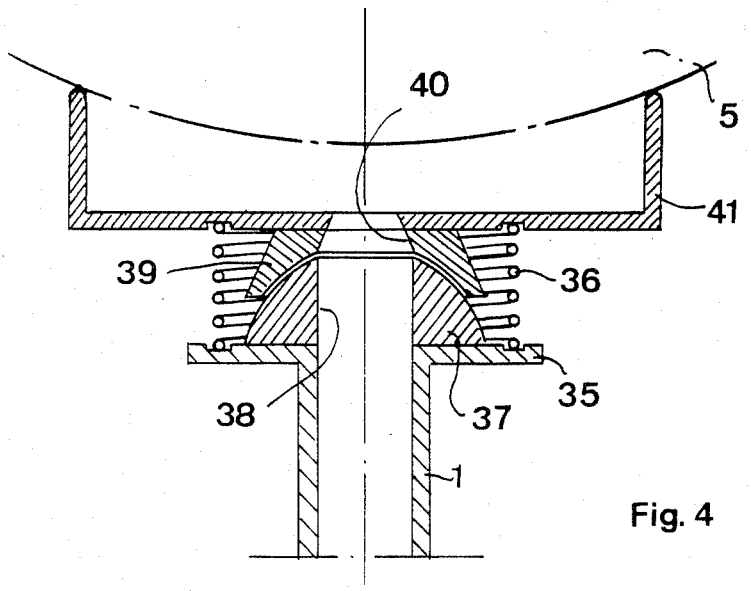
FIG. 4 shows a fourth embodiment of a ball support.
Figure 5:
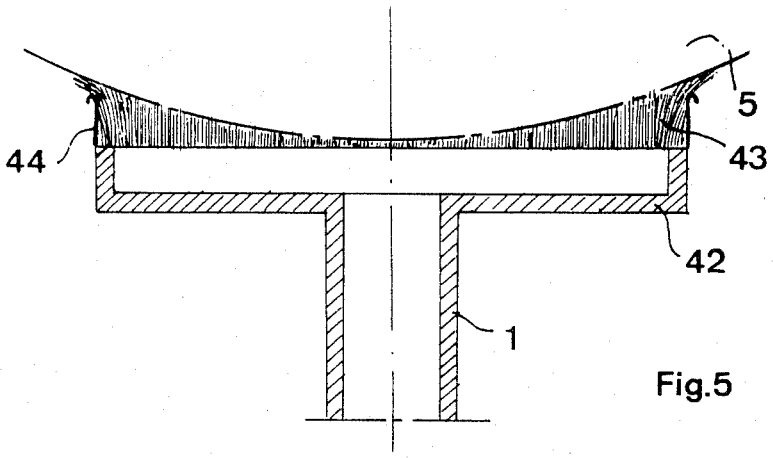
FIG. 5 shows a fifth embodiment of a ball support.

The support device for the ball 5, which in FIG. 1 comprises concave platform 4, may be replaced by the other variants shown in FIGS. 4 and 5. These variants may be employed with or without aspiration devices; however, the following descriptions refer to the use of an aspiration system through the hollow shaft 1.

FIG. 4 shows a cross section of a variant of a support device for ball 5. It comprises a hollow shaft 1 terminated by a flange 35 against which a helical spring 36 is supported, and a basket 41 centered over hollow shaft 1 by means of helical spring 36 and articulated with respect to said hollow shaft 1 by a ball joint.

This ball joint comprises a convex part 37 solidly attached to flange 35 and provided with an opening 38 coaxial to the bore of hollow shaft 1, and a concave part 39 provided with opening 40 and solidly attached to basket 41.

When ball 5 is placed on basket 41, the rotational movement of hollow shaft 1 is transmitted to basket 41 via the two parts 37 and 39 of the ball joint, and via helical spring 36, which on one side rests against flange 35 which is solidly attached to hollow shaft 1 and on the other side rests against the bottom of basket 41.

At the time when the ball is propelled, the horizontal component of the impulse transmitted to the ball forces the basket 41 to give way to the side which is in the path; this retraction occurs due to the freedom of movement afforded by the two parts 37 and 39 of the ball joint. Thereby spring 36 is asymmetrically compressed, allowing the ball to move out.

After the ball has been propelled, helical spring 36, which has been chosen with sufficient rigidity to avoid oscillation of the rotation assembly, recenters basket 41 over hollow shaft 1, and the process can be repeated.

FIG. 5 shows a cross section of another variant of a support device for ball 5. This device comprises a hollow shaft 1 terminated by a platform 42 which supports, over its entire periphery, a brush 43 which is formed from stiff bristles.

The bristles are arrayed in brush 43 in sufficient density that under the weight of ball 5 the collective deformation of brush 43 furnishes a contact surface with ball 5 which enables the latter to be carried along at the desired rotational speed.

In order to reduce the loss of capacity in the aspiration system, brush 43 is surrounded over its entire periphery by a thin sheet 44 of elastic material with a height almost half the length of the bristles of the brush 43. This elastic sheet 44 also contributes to increasing the stiffness of the bristles of brush 43.

The part of the support device which is capable of giving way is comprised of the bristles of brush 43 along with sheet 44 which, at the time of the propelling of the ball, is elastically deformed under the stress developed by the ball..

So as not to counteract, upon impact, the rotational movement imparted to the ball by one of the devices described above, the striking device 9 comprises a free-turning wheel which can turn around an axle whch may be oriented in different directions.

Figure 6:
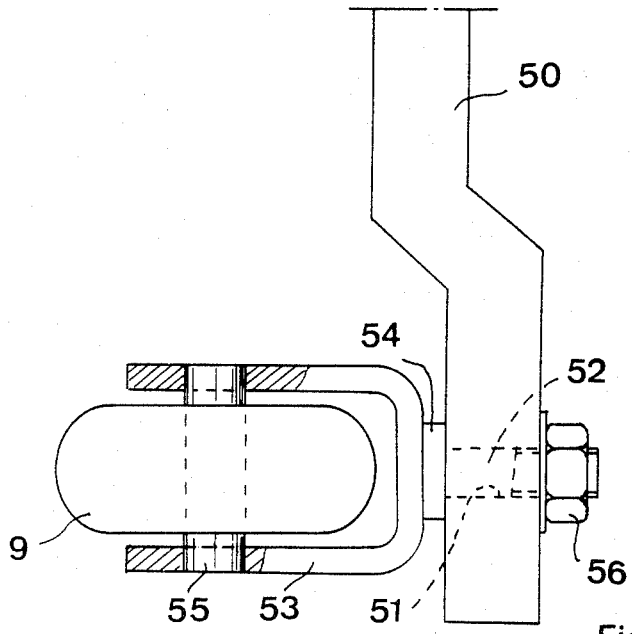
FIG. 6, shows a first embodiment of a striking arm.

FIG. 6 shows an example embodiment of the striking device. It comprises a bent bar 50 provided with a hole 51 on its end into which a projection 52 solidly attached to a stirrup 53 is inserted up to shoulder detent 54. Stirrup 53 bears an axle 55 around which striking mass 9 rotates. Mass 9 has small diameter and low mass, and is rounded on the edges so as not to damage the ball upon impact.

When striking mass 9 strikes ball 5 which is rotating by virtue of one of the above-described support devices, the rotational movement is only retarded to an imperceptible extent if the axle 55 is approximately parallel to the axis of rotation of ball 5.

Control of the orientation of axle 55 is obtained by turning projection 52 in hole 51 in striking arm 50.

After setting the orientation of axle 55, it is held in place by fixing means 56.

A hooked trajectory of the ball can also be attained by supplying the striking mass with a rotation in a suitable direction and with a speed adjustable according to the desired effect on the trajectory.

Figure 7:
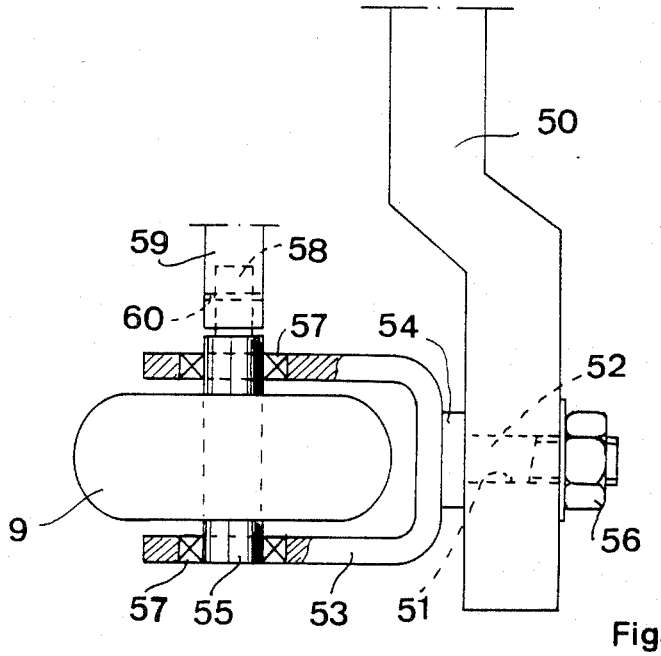
FIG. 7 shows a second embodiment of a striking arm.

FIG. 7 shows an example of realization of this alternate process.

In FIG. 7 the rotational axle 55 of the striking mass 9 is mounted on two needle bearings 57 and has an end 58 which engages a flexible /joint/ 59 which is held on end 58 by fixing means 60.

A motor (not shown) furnishes the striking mass 9 with rotational movement in the desired direction and with the desired speed, via flexible joint 59 which is solidly attached to end 58 by fixing means 60.

In order not to counteract the rotational movement imparted to striking mass 9 at the time of impact with the ball, where said ball is in the position from which it is to be propelled, the ball is held on a support device which is free to pivot i.e., whereby the ball is free to pivot around an axis parallel to axle 55 of the striking mass 9.

According to another variant (not shown), the rotational movement can be transmitted to striking mass 9 via a gear train.

It is also possible, according to another variant (not shown), to mount a turbine on axle 55 of striking mass 9, and under the circumstances, to drive the turbine with compressed air.

Figure 8:
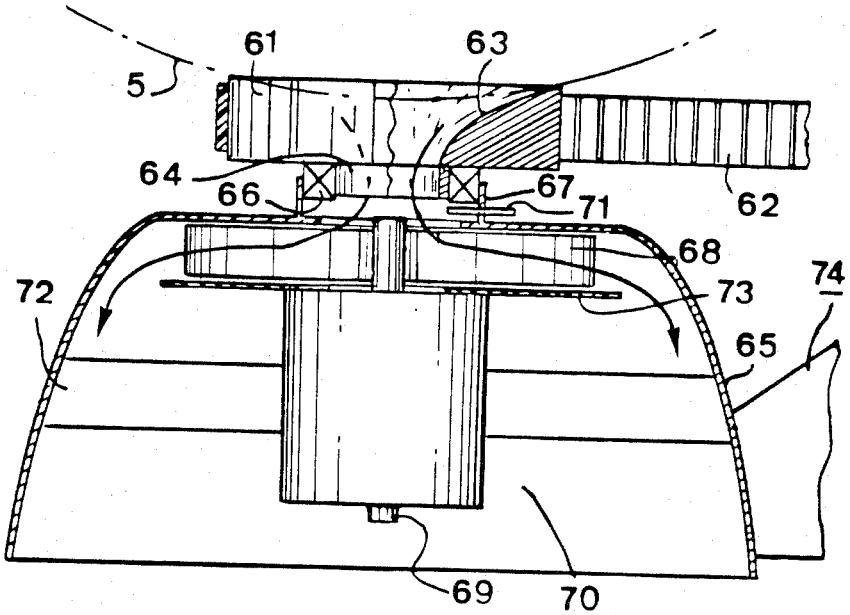
FIG. 8 shows a first embodiment of a suction apparatus for use with a ball support.

FIG. 8 shows another example embodiment. A pulley 61 with circumferential teeth is driven by a notched belt 62 and has a concave space interiorly acting as a cup 63 for positioning the ball.

The concavity of cup 63 is interiorly in fluid communication with the bore at the end of hollow shaft 64 which is solidly attached to pulley 61. This hollow shaft 64 opens out into the top part of a protective cover 65. Hollow shaft 64 is mounted on ball bearing 66 which in turn is supported on a cylindrical collar 67 which is solidly attached to protective cover 65. The top of protective cover 65 is flat in order to enable turbine wheel 68, which is fixed to shaft 69 of a motor 70, to be mounted as close as possible to positioning cup 63.

In the example shown, pulley 61, hollow shaft 64, ball bearing 66, turbine wheel 68, and drive motor 70 are coaxial. Cylindrical collar 67 has an opening in it to accommodate a vacuum tap 71 for connecting to a vacuum transducer which registers the presence of a ball on the positioning cup 63.

Drive motor 70, which can be a low voltage electric motor or a fluid driven turbine, is supported in the interior of the protective cover 65 by a crossbar arrangement 72. A plate 73 of diameter slightly greater than that of turbine wheel 68 is mounted between drive motor 70 and turbine wheel 69 to effect channeling of the air in the interior of the protective cover 65.

If a ball 5 covered with dirt is placed on positioning cup 63, the dirt particles detached from the ball are sucked through cup 63 and hollow shaft 64 and are centrifugally propelled by the turbine wheel against the internal wall of protective cover 65. When deposits of dirt thus formed on the interior of protective cover 65 become detached they fall to the bottom without external intervention.

In the example shown, the protective cover 65 is solidly attached to movable part 74 of the frame, which enables the altitude of ball 5 to be adjusted with respect to the striking mass (striking mass not shown in FIG. 8). This movable part 74 of the frame also bears a motor (not shown) which drives positioning cup 63 via notched belt 62 and imparts to ball 5 a specific rotational velocity in order to achieve a given hooked trajectory.

Figure 9:
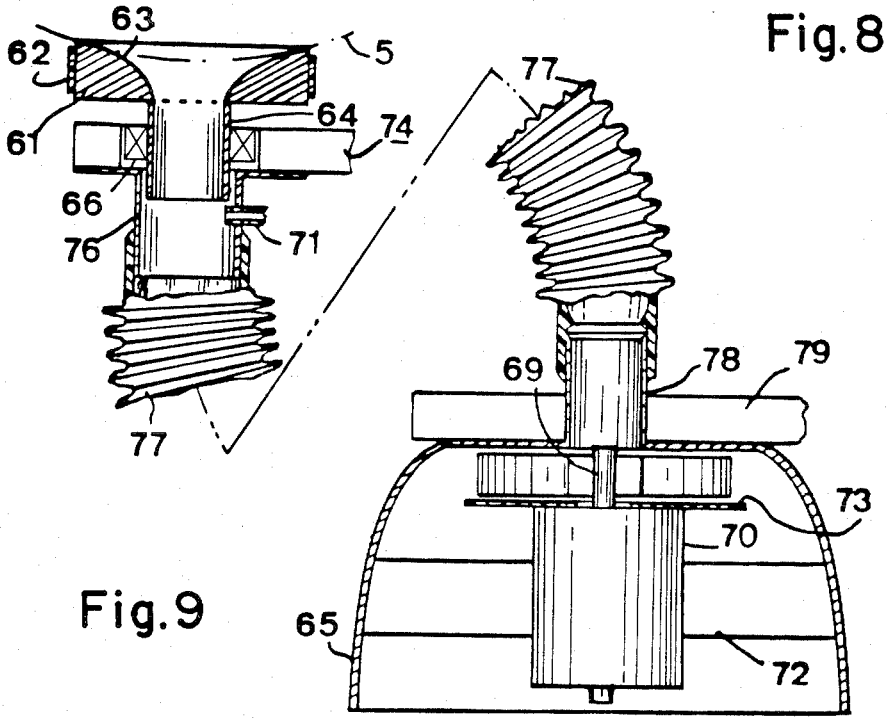
FIG. 9 shows a second embodiment of a suction apparatus for use with a ball support.

In another example embodiment, shown in FIG. 9, the ball support and the elements which provide the rotation are disposed on the movable part 74 of the frame, while the aspiration assembly is mounted on the fixed part of the frame. A flexible hose provides the continuity of the aspiration system, connecting the ball support assembly to the aspiration assembly.

In FIG. 9, pulley 61 driven by belt 62 is configured interiorly as a positioning cup 63 and is solidly attached to a hollow shaft 64 which is mounted on ball bearing 66 which in turn is supported on movable part 74 of the frame. A cylindrical flange piece 76 solidly attached to movable part 74 of the frame has an opening in it to accommodate a vacuum tap 71. One end of flexible vacuum hose 77 is attached to piece 76, and the other end is fitted onto a sleeve 78 near protective cover 65 which rests against fixed part 79 of the frame.

The interior of the protective cover contains crossbars 72 which serve to support drive motor 70. The shaft of drive motor 70 is solidly attached to turbine wheel 68. Plate 73 attached to motor 70 effects channeling of the air flow created by turbine wheel 68 in the interior of protective cover 65.

When dirt particles become detached from a ball 5 which has been placed on positioning cup 63, these particles are sucked through hollow shaft 64, cylindrical flange 76, vacuum hose 77, and sleeve 78, and are then centrifugally propelled by turbine wheel 68 so as to be thrown against the interior wall of protective cover 65.

In the example embodiments shown, detached dirt is centrifugally propelled to a predetermined location, namely onto the protective cover 65. It is obvious that the invention covers equivalent techniques, such as a technique whereby the centrifugal propulsion of the dirt occurs in a cyclone connected in the vacuum system.

What is claimed is:

1. An apparatus for propelling inflated balls by elastic impact, comprising:

a striking mass for travelling through a predetermined elongated path and striking a ball to propell a ball;

a ball support for holding a ball in the path of said striking mass;

means for imparting rotational motion to a ball when propelled by producing relative rotation between said ball support and said mass prior to said mass striking a ball, thereby causing a ball to travel in an arced trajectory; and control means for selecting the direction of rotation and rotational velocity imparted to a ball by said rotational motion imparting means.

2. The apparatus according to claim 1 in which said support is rotatable about a vertical axis of rotation passing through said support, and said rotational motion imparting means comprises motor means connected for rotating said support about said vertical axis of rotation.

3. The apparatus according to claim 1 wherein said striking mass is rotatable about a vertical axis of rotation passing through said striking mass, and said rotational motion imparting means comprises motor means for causing said striking mass to rotate about said vertical axis.

4. The apparatus according to claims 2 or 3 in which said motor means is a reversible, variable speed electric motor.

5. The apparatus according to claims 2 or 3 in which said motor means is a fluid driven turbine.

6. The apparatus according to claim 1 and further including means for adjusting the height of said support relative to said striking mass thereby adjusting the vertical trajectory of a ball.

7. The apparatus according to claim 6 in which said height adjusting means comprises a shaft, and a tube disposed coaxial with said shaft, said shaft bearing said support on an upper end thereof, and said shaft being slidably received in said tube, and engagement means for connecting said shaft to said tube.

8. The apparatus according to claim 6 wherein said height adjusting means comprises a movable frame which is freely displaceable vertically and which mounts said support, and wherein said rotational motion imparting means comprises motor means connected to said support for rotating said support, said motor means being mounted in fixed relation with respect to said frame.

9. An apparatus according to claim 6 including means for holding a ball on said support comprising a ball support frame having biased elements for contacting a ball, said biased elements being capable of being displaced away from the position of a ball for the purpose of inserting and positioning a ball.

10. An apparatus according to claim 6 and further including means for holding a ball on said support, comprising a positioning cup having a small peripheral diameter whereby a ball rests on the edge of said cup, and a pressure reduction means for producing a suction within said cup.

11. An apparatus according to claim 10 wherein said pressure reduction means includes a turbine having a fan disposed immediately downstream of said positioning cup in a vacuum channel.

12. The apparatus according to claim 10 wherein said pressure reduction means is a turbine driven by a high speed motor, said turbine being disposed within a protective cover positioned to catch debris thrown from said turbine.

13. The apparatus according to claim 10 wherein said rotational motion imparting means comprises said positioning cup and means for rotating said cup.

14. The apparatus according to claim 1 wherein said support comprises a crown-shaped structure formed from brush bristles.

* * * * *